US005375271A

United States Patent [19]

Frankel

[11] Patent Number: 5,375,271

[45] Date of Patent: Dec. 27, 1994

[54] BATH MAT HAVING TEMPERATURE RELATED INDICIA

[75] Inventor: Gail B. Frankel, Dallas, Tex.

[73] Assignee: Kel-Gar, Inc., Dallas, Tex.

[21] Appl. No.: 129,843

[22] Filed: Sep. 30, 1993

[51] Int. Cl.[5] ..... A47K 3/02

[52] U.S. Cl. ..... 4/581; 4/583; 4/605

[58] Field of Search ..... 4/580–583, 4/605, 559; 116/216; 374/161, 162, 141

[56] References Cited

U.S. PATENT DOCUMENTS

| | | | |
|---|---|---|---|
| 1,668,930 | 5/1928 | Zadek . | |
| 2,019,221 | 10/1935 | Hastings | 73/118 |
| 2,091,693 | 8/1937 | Spencer | 73/353 |
| 4,030,361 | 6/1977 | Fortune | 73/353 |
| 4,629,330 | 12/1986 | Nichols | 116/216 |
| 4,644,592 | 2/1987 | Small | 4/583 |
| 5,085,607 | 2/1992 | Shibahashi et al. | 446/14 |

FOREIGN PATENT DOCUMENTS

| | | | |
|---|---|---|---|
| 143550 | 5/1985 | European Pat. Off. | 116/216 |
| 26236 | 2/1983 | Japan | 374/162 |
| 2108838 | 5/1983 | United Kingdom . | |

*Primary Examiner*—Henry J. Recla
*Assistant Examiner*—Gregory M. Vidovich
*Attorney, Agent, or Firm*—Konneker Bush Hitt & Chwang

[57] ABSTRACT

Apparatus for determining whether the temperature of bath water is below a selected temperature. A bath mat having temperature related indicia imprinted on a top side surface thereof has a layer of temperature sensitive ink applied over the temperature related indicia. The temperature sensitive ink is selected such that it is transparent above the selected temperature and at least partially opaque below the selected temperature. When the temperature of the bath water exceeds the selected temperature, the temperature sensitive ink is transparent and, when the temperature of the bath water is below the selected temperature, the temperature sensitive ink is at least partially opaque.

20 Claims, 1 Drawing Sheet

BATH MAT HAVING TEMPERATURE RELATED INDICIA

BACKGROUND OF THE INVENTION

1. Field of the Invention

The present invention generally relates to a bath mat having temperature sensitive indicia formed thereon and, more particularly, to a bath mat having at least one temperature related indicia printed thereon which is visible only at selected temperature ranges.

2. Description of Related Art

Bath mats have long been commercially available. Typically, bath mats are placed in a bathtub to provide a surface to stand on when entering or leaving the tub. Most bath mats are also constructed to provide a non-slip surface, thereby decreasing the risk of injury from a slip or fall when entering or leaving the tub. While commonly recognized as a safety device which prevents injuries to adults, it is further recognized that the bath mat will also prevent infants and/or toddlers from slipping and striking the ceramic or metallic surfaces of the bathtub or its fixtures, either during the seating of the infant or toddlers in the bathtub by a supervising adult or during the bath itself. In addition to the risk of injury which may result if an infant or toddler slips in the bathtub, both infants and toddlers face a considerable risk of being scalded when placed in a bathtub filled with hot water. Quite simply, most adults are much less sensitive to hot water than infants or toddlers. As a result, bath water which may seem "warm" to an adult will readily scald an infant or toddler placed in the same water. It would be desirable, therefore, to provide a device capable of measuring the temperature of bath water, particular if the device could relate the measured temperature to the correct temperatures for bathing an infant or toddler. It would also be desirable if such a device could be incorporated with other devices already in use during the bath, thereby alleviating the added confusion which would result if a device for measuring water temperatures was separately placed in the bath water. It would be desirable, therefore, to provide a bath mat having temperature sensitive indicia formed thereon which relate the measured temperature of bath water to the proper temperature range for which an infant or toddler may be placed in the water without risk of injury, thereby combining the safety features of the bath mat with the additional safety considerations which result from the use of a device for measuring water temperature. It is, therefore, an object of this invention to provide such a bath mat.

SUMMARY OF THE INVENTION

In one embodiment, the present invention is of an apparatus for determining whether the temperature of bath water is below a selected temperature. The apparatus includes a bath mat having temperature related indicia imprinted on a top side surface thereof and a layer of temperature sensitive ink applied over the temperature related indicia. The temperature sensitive ink is selected such that it is transparent above the selected temperature and at least partially opaque below the selected temperature. When the temperature of the bath water exceeds the selected temperature, the temperature sensitive ink is transparent and, when the temperature of the bath water is below the selected temperature, the temperature sensitive ink is at least partially opaque. In one aspect of this embodiment, the temperature sensitive ink becomes transparent at about 104 to 106 degrees Fahrenheit, thereby revealing the temperature related indicia which, in another embodiment, is a printed alphanumeric character sequence which reads "too hot".

In one aspect thereof, the temperature related indicia imprinted on the top side surface of the bath mat is comprised of a boundary line which encloses a portion of the top side surface and a printed alphanumeric character sequence located within the enclosed area. In this aspect, the temperature sensitive ink is applied over the enclosed portion of the top side surface. In yet another aspect, the bath mat further includes a first portion of a rendering imprinted on the top side surface thereof. In this aspect, the enclosed portion of the top side surface is shaped and located such that it forms a second portion of the rendering. The first portion of the rendering may be a head and trunk portion of an elephant and the second portion of the rendering may be a bubble exiting an open end of an elephant trunk.

In another embodiment, the present invention is of an apparatus for determining whether the temperature of bath water is within a desired temperature range. The apparatus includes a bath mat having temperature related indicia imprinted on a top side surface thereof and a layer of temperature sensitive ink applied over the temperature related indicia. The temperature sensitive ink is selected such that it is opaque below about 91 to 92 degrees Fahrenheit, partially opaque between about 91 to 92 degrees Fahrenheit and about 104 to 106 degrees Fahrenheit and transparent above about 104 to 106 degrees Fahrenheit. The bath water is within the desired temperature range when the temperature sensitive ink is partially opaque and the temperature related indicia visible and the bath water is outside the selected range when the temperature sensitive ink is opaque and the temperature indicia is obscured or the temperature sensitive ink is transparent and the temperature indicia is visible. In one aspect, the temperature related indicia is imprinted in a first color and the temperature sensitive ink is applied over the temperature related indicia in a second color which sharply contrasts with the first color.

In one aspect thereof, the temperature related indicia imprinted on the top side surface of the bath mat is comprised of a boundary line which encloses a portion of the top side surface and a printed alphanumeric character sequence located within the enclosed area. In this aspect, the temperature sensitive ink is applied over the enclosed portion of the top side surface. In yet another aspect, the bath mat further includes a first portion of a rendering imprinted on the top side surface thereof. In this aspect, the enclosed portion of the top side surface is shaped and located such that it forms a second portion of the rendering. The first portion of the rendering may be a head and trunk portion of an elephant and the second portion of the rendering may be a bubble exiting an open end of an elephant trunk.

In yet another embodiment, the present invention is of an apparatus for determining whether the temperature of bath water is below a selected temperature. The apparatus includes a bath mat having first, second and third temperature related indicia, imprinted on a top side surface thereof, a first layer of a first temperature sensitive ink applied over the first temperature related indicia, a second layer of a second temperature sensitive ink applied over the second temperature related indicia, and a third layer of a third temperature sensitive ink applied over the third temperature related indicia. The first temperature sensitive ink is at least partially transparent within a first temperature range and opaque outside the first temperature range, the second temperature sensitive ink is at least partially transparent within a second temperature range and opaque outside the second temperature range and the third temperature sensitive ink is at least partially transparent within a third temperature range and opaque outside of the third temperature range such that the first, second and third temperature related indicia are visible when the temperature is within the first, second and third temperature ranges, respectively. In one aspect, the first temperature range is below about 95 degrees Fahrenheit, the second temperature range is between about 95 degrees and about 98 degrees Fahrenheit and the third temperature range is above about 104 degrees Fahrenheit. In another aspect, the first, second and third temperature indicias are respectively comprised of first, second and third boundary lines which respectively enclose first, second and third portions of the top side surface and first, second and third printed alphanumeric character sequences respectively located within the first, second and third enclosed areas.

BRIEF DESCRIPTION OF THE DRAWING

The invention will be better understood, and its numerous objects, advantages and features will become apparent to those skilled in the art by reference to the following drawings in which.

DETAILED DESCRIPTION

Figure 1:
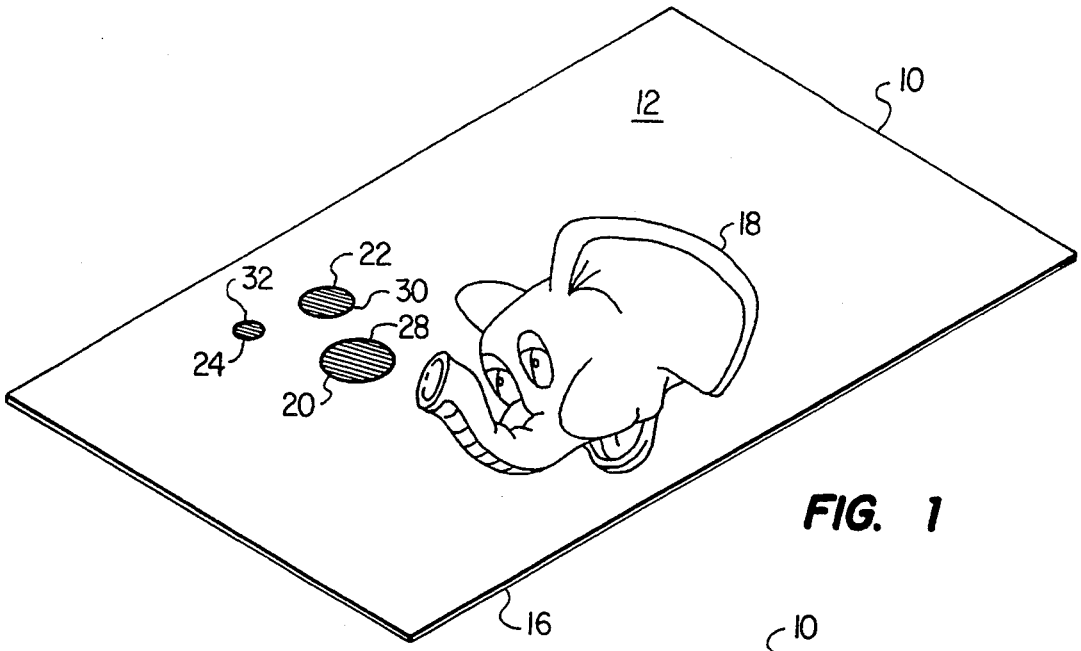
FIG. 1 is a perspective view of a bath mat having temperature related indicia which is constructed in accordance with the teachings of the present invention.
Figure 2:
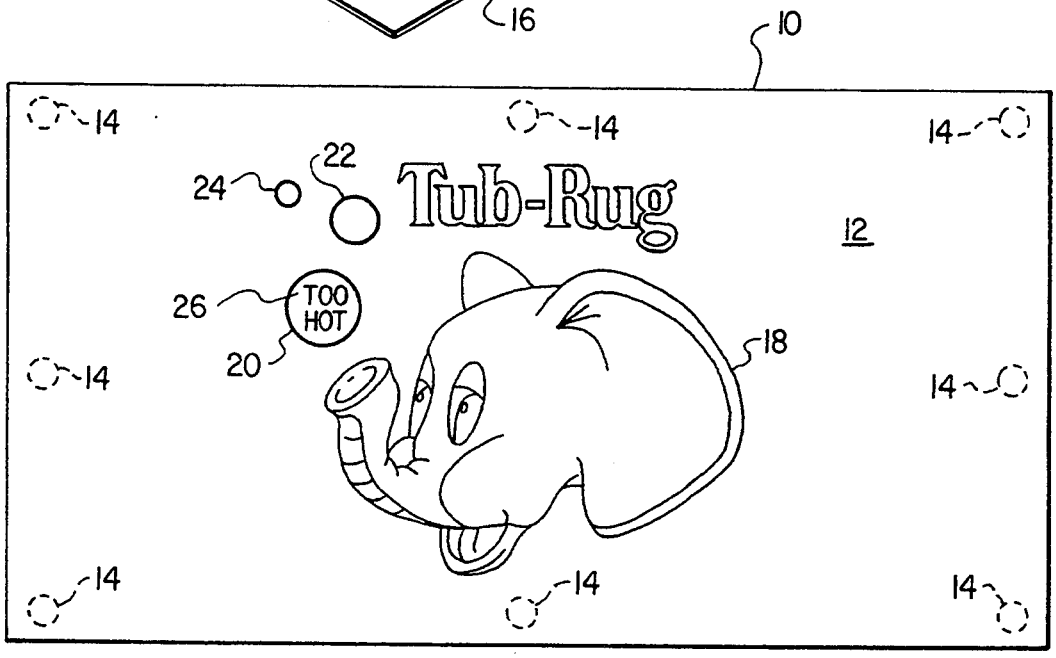
FIG. 2 is a top view of the bath mat having temperature related indicia of FIG. 1.

Referring first to FIG. 1, a bath mat 10 having temperature related indicia which is constructed in accordance with the teachings of the present invention may now be seen. The bath mat 10 is constructed of a soft, PVC foam material having a generally rectangular, top side surface 12 textured to be slip resistant. The bath mat 10 is sized to readily fit within a bathtub and includes a plurality of suction members 14 (illustrated in phantom in FIG. 2) attached to a bottom side surface 16 of the bath mat 10. To fixedly secure the bath mat 10 onto a bathtub surface (not shown), the bottom side surface 16 is placed on the surface to which the bath mat 10 is to be secured. Pressure is then applied to the top side surface 12 to cause the suction members 14 to engage the bathtub surface, thereby securing the bath mat 10 to the bathtub surface. While eight suction to members 14 are illustrated in FIG. 2 for exemplary purposes, it is noted that any number of suction members 14 may be provided on the bottom side surface 16 of the bath mat 10 and that the use of such additional suction members 14 would improve the securement of the bath mat 10 to the bathtub surface, thereby reducing the likelihood of the bath mat slipping relative to the bathtub surface. For example, it is contemplated that suction members similar in design to those illustrated may be provided along the entire periphery of the bottom side surface 16 of the bath mat 10.

Imprinted on the top side surface 12 of the bath mat 10 is an artistic rendering 18 of a head and trunk portion of an elephant. Also imprinted on the top side surface 18 in proximity to the rendering 18 are first, second and third circles 20, 22 and 24, respectively. Alternately, other geometric or free-form planar figures, preferably, figures which include an imprinted boundary line which encircles a portion of the surface area of the top side surface 12, may be utilized in place of the circles 20, 22 and 24. Preferably, the rendering 18 and circles 20, 22, 24 are imprinted on the top side surface 12 using a permanent, non-toxic ink. The circles 20, 22 and 24 are imprinted at locations, relative to the rendering 18, such that the circles 20, 22 and 24 appear to form a second portion of the rendering 18. For example, in the embodiment of the invention illustrated herein, the circles 20, 22 and 24 are located and sized such that they appear to resemble bubbles which have come out of the elephant's trunk. As may be seen in FIG. 2, imprinted within the surface area enclosed by the circle 20, or other geometric or free-form figure, again using a permanent, non-toxic ink, is temperature related indicia 26, for example, an alphanumeric sequence which reads "TOO HOT".

Returning now to FIG. 1, a layers 28, 30 and 32 of a temperature sensitive ink, for example, a selected one of the various types of chromic ink manufactured by Matsui International Co., Inc. of El Segundo, Calif. is applied to the areas of the front side surface 12 of the bath mat 10 which are enclosed by the circles 20, 22 and 24, respectively, thereby covering the temperature relative indicia 26. Typically, the temperature sensitive ink will be applied to the front side surface 12 by either a spraying or electrostatic application process.

Generally speaking, a chromic ink is a type of ink which will change from a first color to a second color when the ink reaches a particular temperature. One of the selected colors may be "colorless", where the ink becomes transparent. All temperature sensitive inks have a temperature range in which ink will change from its original color to its second color. In the embodiment of the invention disclosed herein, the temperature sensitive ink is selected such that its first color is opaque, i.e., the temperature related indicia 26 being covered by the ink is not visible and its second color is transparent, i.e., the temperature related indicia being covered by the ink is visible, and the temperature at which the ink will become completely transparent is about 104–106 degrees Fahrenheit. For example, a fast blue Matsui type 41 regular chromic ink has proven suitable for the uses proposed herein. Such a chromic ink is an opaque blue color below 91.4 degrees Fahrenheit such that the temperature related indicia imprinted therebelow cannot be seen. At 91.4 degrees the blue coloring begins to disappear and the temperature related indicia 26 imprinted therebelow begins to become visible. Finally, at 105.8 degrees Fahrenheit, the ink is entirely transparent and the temperature related indicia 26 therebelow is clearly visible.

To use the bath mat 10 subject of the present invention, the bath mat 10 is placed in an empty, bathtub and secured to the surface thereof. It should be noted, however, that the bath mat 10 will operate equally well in a bathtub already partially or completely filled with water. The water faucets may then be opened to begin filling the bathtub with water. As water fills the bathtub, the temperature of the temperature sensitive ink 28, 30, 32 will quickly match that of the water. When the temperature exceeds 91.4 degrees Fahrenheit, the opaque color will begin to gradually change to a transparent color, thus beginning to reveal the temperature related indicia 26 imprinted on the front side surface 12 of the bath mat 10. If the temperature of the water continues to rise and begins to approach 105.8 degrees Fahrenheit, the layers 28, 30 and 32 will become transparent, thereby clearly revealing the temperature related indicia 26.

Thus, the imprinted temperature related indicia 26, together with the layer 28 of temperature sensitive ink may be used to gauge the temperature of bath water, thereby preventing the an adult from attempting to bathe an infant or toddler in excessively hot water capable of scalding the child. More specifically, by observing the bath mat 10 when filling the bathtub, the adult will be informed by the bath mat 10 that the water is too hot for an infant or toddler to be bathed therein when the words "TOO HOT" become visible on the bath mat 10. The adult may then allow the water to gradually cool off, or add cold water thereto, to lower the temperature of the water until the color of the layer 28 of temperature sensitive ink begins to return to the opaque first color and the words "TOO HOT" which form the temperature related indicia 26 starts to disappear. It should be noted, however, that as temperature sensitive inks tend to return to their first color at a lower temperature than the temperature at which they switch to their second color, it may be desirable to add additional hot water to the bathtub if the temperature related indicia 26 disappears entirely.

The tendency of the layer 28 of ink to gradually disappear over a temperature range may also be exploited to ensure that the infant or toddler is placed in the bathtub only when the water is within a desired temperature range. For example, it is commonly accepted that water temperatures below 95 degrees Fahrenheit are too cold for bathing infants or toddlers, temperatures between 95 and 98 degrees Fahrenheit are considered the ideal temperatures in which to bathe infants or toddlers while temperatures above 104 degrees are generally considered too hot. As previously discussed, temperature sensitive inks tend to begin to change color at a threshold temperature. Typically, the color change is relatively minor for the first part of the temperature range but, as the temperature of the ink begins to approach the upper value of the temperature range where color change is complete, the color of the ink begins to change more rapidly. For example, while type 27 ink begins to change from its first to its second color at 24 degrees Centigrade and is completely changed to the second color at 33 degrees Centigrade, between 24 and 29 degrees Centigrade, the color density of the first color will have only dropped about 20%. Between 29 and 31 degrees Centigrade, however, the color density of the first color will drop about 60% more.

As previously stated, the change from an opaque blue color to a transparent color for the temperature sensitive ink selected for use as the layers 28, 30 and 32, begins at 91.4 degrees Fahrenheit and is complete at 105.8 degrees Fahrenheit. Thus, if the temperature related indicia 26 remains hidden under the layer 28, the temperature of the water is below 91.4 degrees Fahrenheit and is, therefore, too cold to be used for bathing purposes. Furthermore, since the color changes very gradually at first, the temperature related indicia 26 will remain hidden or barely visible when the temperature of the water is 92 or 93 degrees Fahrenheit. However, as the temperature of the water enters the aforementioned ideal temperature range, the layer 28 will become increasingly transparent and the temperature related indicia 26 will begin to become clearly visible underneath the layer 28. If, however, the layer 28 becomes nearly or completely transparent, the temperature of the water has become too hot to be used for bathing purposes. The ability to discern the temperature related indicia 26 underneath the layer 28 of temperature sensitive ink when the layer 28 has partially changed to the transparent color, may be enhanced by imprinting the temperature related indicia 26 in a color which contrasts with the color of the layer 28. For example, if the color of the layer 28 is a deep blue, pink would be a suitable contrasting color for the temperature related indicia 26. While various colors may be selected for both the temperature related indicia 26 and the layer 28 of temperature sensitive ink, care should be taken when selecting the colors to ensure that the temperature related indicia 26 is not readily visible underneath the layer 28 when in its first, low temperature, color and clearly visible when in its second, high temperature, color.

Figure 3:
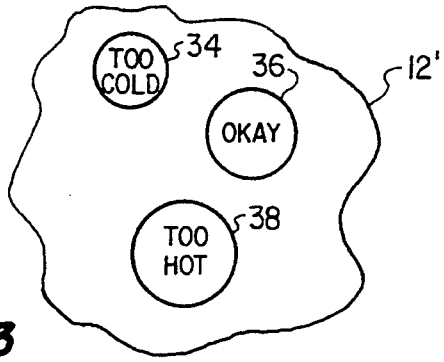
FIG. 3 is partial top view of an alternate embodiment of the bath mat having temperature related indicia of FIGS. 1 and 2.

Referring next to FIG. 3, an alternate embodiment of the invention may now be seen. Rather than a single alphanumeric character sequence, i.e., "TOO HOT" to provide the temperature related indicia 26 for the bath mat 10, in this embodiment, first, second and third temperature related indicias 34, 36 and 38 are imprinted on the top side surface 12' of the bath mat 10. When visible, the first temperature related indicia 34 indicates that the water is "TOO COLD" to bathe an infant or toddler, the second temperature related indicia 36 indicates that the water is "OKAY" and the third temperature related indicia 38 indicates that the temperature is "TOO HOT" for bathing. By the terms "TOO COLD", "OKAY" and "TOO HOT", it is intended to refer to water that is below 95, between 95 and 98, and above 104 degrees Fahrenheit, respectively. As before, a layer of temperature sensitive ink (not shown in FIG. 3) should be applied to each of the first, second and third temperature related indicias 34, 36 and 38. In this embodiment, however, a different ink having a different temperature range and color change should be selected for each of the temperature related indicias 34, 36 and 38. For example, the first temperature related indicia 34 is preferably covered with an ink which is opaque at about 95 degrees Fahrenheit but is partially or completely transparent below that temperature. The third temperature indicia 38 is preferably covered with the same type, i.e., is transparent above 105.8 degrees Fahrenheit but completely or partially opaque below that, of temperature sensitive ink previously described with respect to FIGS. 1 and 2. Finally, the second temperature indicia 36 is preferably covered with a three color ink, i.e., a temperature sensitive ink capable of changing between three colors in which the first and third colors are opaque (and may be the same color) and the second, or intermediate, color is transparent. For example, the second temperature sensitive ink may be selected such that the ink will change from the first opaque color to the second, transparent, color at about 93–95 degrees Fahrenheit and will change from the second, transparent, color to the third, opaque, color at about 98–100 degrees Fahrenheit. Alternately, a three color ink which transitions between a first opaque color, a transparent color and a second opaque color may be selected to cover the first temperature related indicia 34. In this embodiment, the first ink should be an opaque color at room temperature (about 75 degrees Fahrenheit), be transparent between about 75 and 95 degrees Fahrenheit and be opaque above 95 degrees Fahrenheit.

When a bath mat 10 having first, second and third temperature related indicias 34, 36 and 38 imprinted on the top side surface 12' thereof is placed in a bathtub which is then filled with water, only the first temperature related indicia 34 will be visible initially. When the temperature reaches the desired range, the first temperature related indicia 34 will begin to disappear and the second temperature related indicia 36 will begin to appear as the layer of temperature sensitive ink covering the first temperature related indicia 34 begins to change into an opaque color while the layer of temperature sensitive ink covering the second temperature related indicia 36 begins to change from an opaque color into a transparent color. If, however, the water is accidently overheated, the second temperature related indicia 36 will begin to disappear and the third temperature related indicia 38 will begin to appear as the layer of temperature sensitive ink covering the second temperature indicia 36 changes from transparent to its third, opaque, color and the third temperature indicia 38 changes from its first, opaque, color to its second, transparent color.

Thus, there has been described and illustrated herein a bath mat having temperature related indicia formed thereon from which the suitability of bath water in which the bath mat is placed for bathing infants and toddlers may be readily ascertained by determining whether the temperature related indicia on the bath mat are visible. However, those skilled in the art will recognize that numerous modifications and variations from that specifically disclosed herein are possible without substantially departing from the scope of the present invention. It should be clearly understood, therefore, that the embodiment of the invention disclosed herein is considered to be exemplary only and should not be construed as limiting the invention, which is defined only by the claims appended hereto.

What is claimed is:

1. Apparatus for determining whether the temperature of bath water is below a selected temperature and for enhancing safe usage of a bathtub holding said bath water, comprising:

a bath mat formed of a soft, deformable material, said bath mat having a slip resistant top side surface, a bottom side surface having means for removably mounting said bath mat to a bottom wall of a bathtub, and temperature related indicia imprinted on said top side surface; and a layer of temperature sensitive ink applied over said temperature related indicia, said temperature sensitive ink being transparent above said selected temperature and at least partially opaque below said selected temperature; wherein the mounting of said bath mat to said bottom wall of said bathtub provides, along said bottom wall, a slip-resisting, fall-cushioning, temperature indicating bathing surface in which said temperature related indicia is visible when the temperature of said bath water exceeds said selected temperature and said temperature related indicia is at least partially obscured when the temperature of said bath water is below said selected temperature.

2. An apparatus according to claim 1 wherein said temperature sensitive ink is selected such that it becomes transparent at about 104 to 106 degrees Fahrenheit.

3. An apparatus according to claim 2 wherein said temperature related indicia imprinted on said top side surface of said bath mat is comprised of a printed alphanumeric character sequence which reads "too hot".

4. An apparatus according to claim 1 wherein said temperature related indicia imprinted on said top side surface of said bath mat includes a boundary line which encloses a portion of said top side surface and a printed alphanumeric character sequence located within said enclosed portion.

5. An apparatus according to claim 4 wherein said temperature sensitive ink is applied over said enclosed portion of said top side surface.

6. An apparatus according to claim 5 and further comprising a first portion of a rendering imprinted on said top side surface of said bath mat and wherein said enclosed portion of said top side surface to which said temperature sensitive ink is applied thereto is shaped and located such that it forms a second portion of said rendering.

7. An apparatus according to claim 6 wherein said first portion of said rendering resembles a head and trunk of an elephant and wherein said second portion of said rendering is located in proximity to said first portion of said rendering and is shaped to resemble a bubble exiting an open end of the elephant trunk.

8. An apparatus according to claim 7 wherein said temperature sensitive ink is selected such that it becomes transparent at about 104 to 106 degrees Fahrenheit.

9. An apparatus according to claim 8 wherein said temperature related indicia imprinted on said top side surface of said bath mat is comprised of a printed alphanumeric sequence which reads "too hot".

10. Apparatus for determining whether the temperature of bath water is within a desired temperature range and for enhancing safe usage of a bathtub holding said bath water, comprising:

a bath mat formed of a soft, deformable material, said bath mat having a slip resistant top side surface, a bottom side surface having means for removably mounting said bath mat to a bottom wall of a bathtub, and temperature related indicia imprinted on said top side surface; and a layer of temperature sensitive ink applied over said temperature related indicia, said temperature sensitive ink being selected such that it is opaque below about 92 degrees Fahrenheit, partially opaque between about 92 degrees Fahrenheit and about 106 degrees Fahrenheit and transparent above about 106 degrees Fahrenheit; wherein the mounting of said bath math to said bottom wall of said bathtub provides, along said bottom wall, a slip-resisting, fall-cushioning, temperature indicating bathing surface in which said bath water is within said desired temperature range when said temperature sensitive ink is partially opaque and said temperature related indicia is partially visible; and said bath water is outside said selected range when said temperature sensitive ink is opaque and said temperature related indicia is obscured or when said temperature sensitive ink is transparent and said temperature related indicia is visible.

11. An apparatus according to claim 10 wherein said temperature related indicia is imprinted on said top side surface of said bath mat in a first color and said temperature sensitive ink is applied over said temperature related indicia in a second color which sharply contrasts with said first color.

12. An apparatus according to claim 10 wherein said temperature related indicia imprinted on said top side surface of said bath mat includes a boundary line which encloses a portion of said top side surface and a printed alphanumeric character sequence located within said enclosed portion.

13. An apparatus according to claim 12 wherein said temperature sensitive ink is applied over said enclosed portion of said top side surface.

14. An apparatus according to claim 13 and further comprising a first portion of a rendering imprinted on said top side surface of said bath mat and wherein said enclosed portion of said top side surface to which said temperature sensitive ink is applied thereto is shaped and located such that it forms a second portion of said rendering.

15. An apparatus according to claim 14 wherein said first portion of said rendering resembles a head and trunk of an elephant and wherein said second portion of said rendering is located in proximity to said first portion of said rendering and is shaped to resemble a bubble exiting an open end of the elephant trunk.

16. An apparatus according to claim 15 wherein said temperature related indicia imprinted on said top side surface of said bath mat is comprised of a printed alphanumeric sequence which reads "too hot".

17. Apparatus for determining whether the temperature of bath water is below a selected temperature and for enhancing safe usage of a bathtub holding said bath water, comprising:

a bath mat formed of a soft, deformable material, said bath mat having a slip resistant top side surface, a bottom side surface having means for removably mounting said bath mat to a bottom wall of a bath tub, and first, second and third temperature related indicias imprinted on said top side surface;

a first layer of a first temperature sensitive ink applied over said first temperature related indicia, said first temperature sensitive ink being at least partially transparent within a first temperature range and opaque outside said first temperature range;

a second layer of a second temperature sensitive ink applied over said second temperature related indicia, said second temperature sensitive ink being at least partially transparent within a second temperature range and being opaque outside said second temperature range, said second temperature range having higher temperatures than said first temperature range;

a third layer of a third temperature sensitive ink applied over said third temperature related indicia, said third temperature sensitive ink being at least partially transparent within a third temperature range and opaque outside of said third temperature range, said third temperature range having higher temperatures than said second temperature range; wherein the mounting of said bath mat to said bottom wall of said bathtub provides, along said bottom wall, a slip-resisting, fall-cushioning, temperature indicating bathing surface in which said first, second and third temperature related indicia are visible when the temperature is within said first, second and third temperature ranges, respectively.

18. An apparatus according to claim 17 wherein said first temperature range is below about 95 degrees Fahrenheit, said second temperature range is between about 95 degrees and about 98 degrees Fahrenheit and said third temperature range is above about 104 degrees Fahrenheit.

19. An apparatus according to claim 18 wherein said first, second and third temperature related indicias imprinted on said top side surface of said bath mat are respectively comprised of first, second and third boundary lines which respectively enclose first, second and third portions of said top side surface and first, second and third printed alphanumeric character sequences respectively located within said first, second and third enclosed portions.

20. An apparatus according to claim 9 wherein said means for removably mounting said bath mat to a bottom wall of a bathtub further comprises a plurality of suction members attached at spaced locations along said bottom side surface of said bath mat.

* * * * *